US007992338B2

(12) United States Patent
Bowman et al.

(10) Patent No.: US 7,992,338 B2
(45) Date of Patent: Aug. 9, 2011

(54) FINGER ALIGNMENT DEVICES FOR TRIGGERS AND TRIGGER-ACTIVATED DEVICES INCORPORATING THE SAME

(76) Inventors: Paul P. Bowman, Manalapan, NJ (US); Mark S. Weissman, East Brunswick, NJ (US)

( * ) Notice: Subject to any disclaimer, the term of this patent is extended or adjusted under 35 U.S.C. 154(b) by 1057 days.

(21) Appl. No.: 11/789,757

(22) Filed: Apr. 24, 2007

(65) Prior Publication Data

US 2011/0167691 A1 Jul. 14, 2011

Related U.S. Application Data

(60) Provisional application No. 60/847,003, filed on Sep. 25, 2006.

(51) Int. Cl.
*F41A 19/07* (2006.01)

(52) U.S. Cl. ..... 42/90

(58) Field of Classification Search ..... 89/1.4; 42/90

See application file for complete search history.

(56) References Cited

U.S. PATENT DOCUMENTS

| | | | | |
|---|---|---|---|---|
| 3,542,639 | A | 11/1970 | Manino | |
| 4,005,540 | A | 2/1977 | Robinson | |
| 4,691,461 | A | 9/1987 | Behlert | |
| 4,835,893 | A | 6/1989 | Kelso | |
| 5,402,593 | A * | 4/1995 | Lenkarski et al. | 42/70.06 |
| 5,406,731 | A | 4/1995 | Stevens | |
| 5,938,678 | A | 8/1999 | Zirps et al. | |
| 6,499,243 | B1 * | 12/2002 | Herzog | 42/70.07 |
| 6,651,642 | B1 * | 11/2003 | Powers | 124/35.2 |
| 6,804,907 | B1 | 10/2004 | Slobodkin | |
| 6,957,644 | B2 | 10/2005 | Simo et al. | |
| 7,392,611 | B2 * | 7/2008 | Curry | 42/69.01 |
| 2005/0188587 | A1 | 9/2005 | Danas | |
| 2006/0005444 | A1 * | 1/2006 | Peles | 42/70.07 |
| 2006/0207149 | A1 | 9/2006 | Lazor | |

OTHER PUBLICATIONS

"Firearms Licensing," The Firearms and Explosives Division. www.pnp.gov.ph/reg/content/fa.html (2007).

"Binks Wren Air Brushes Models 59-10001 'A', 59-10002 'B', and 59-10021 'C' Operating Instructions," Binks. Part Sheet 1541R-12 (Nov. 2000).

"Trigger Control: Chapter 3: Army Marksmanship Training Guide," Bullseyepistol.com (1979).

Chandler, John, et al., "Target Pistol Shot Analysis," The UIT Pistol Book.

* cited by examiner

*Primary Examiner* — Stephen M Johnson

(74) *Attorney, Agent, or Firm* — Dascenzo Intellectual Property Law, P.C.

(57) ABSTRACT

Alignment devices for assisting proper location of fingers relative to the triggers of trigger-activated devices, trigger-activated devices, finger position indicating triggers for trigger-activated devices, and methods for activating a trigger-activated device are disclosed. Alignment devices for assisting proper location of a finger relative to a trigger may include a body having a trigger face configured to engage a user's finger, a trigger-engaging region, and a position indicator disposed on the trigger face. The trigger-engaging region may be adapted to couple the alignment device to a trigger of a trigger-activated device. The trigger-engaging region may be configured to position the trigger face in a predetermined position relative to the trigger. The position indicator may be disposed on the trigger face. The position indicator may be configured to provide an indication that at least a portion of the finger is positioned in a predetermined lateral position relative to the trigger.

30 Claims, 5 Drawing Sheets

Fig. 1
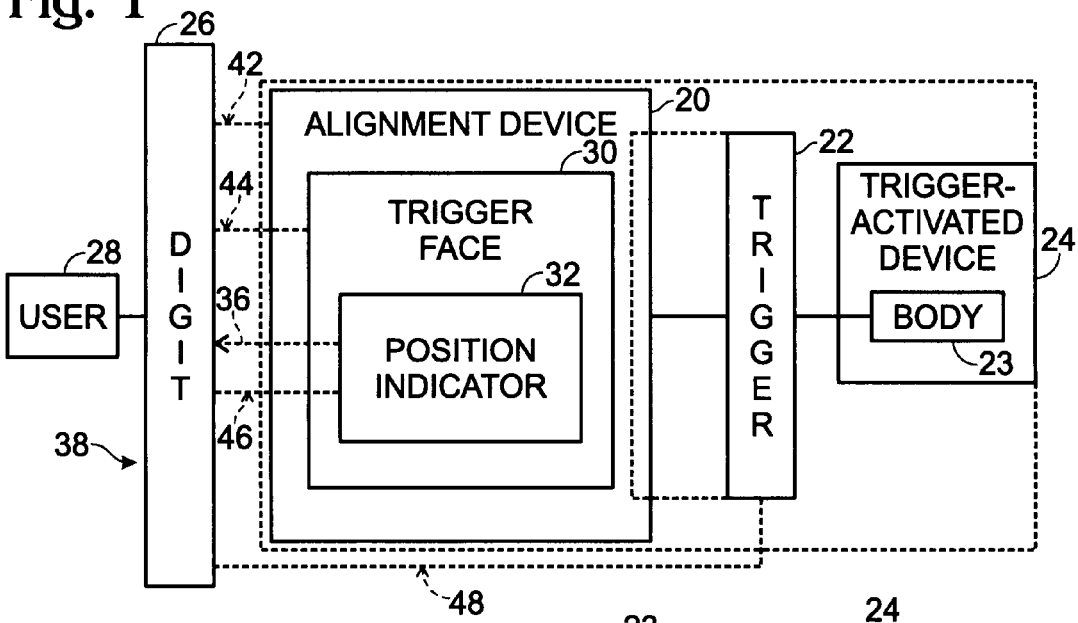
Fig. 3
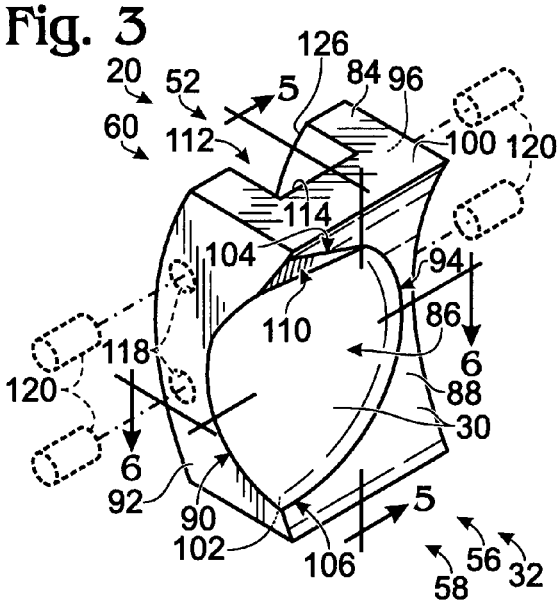
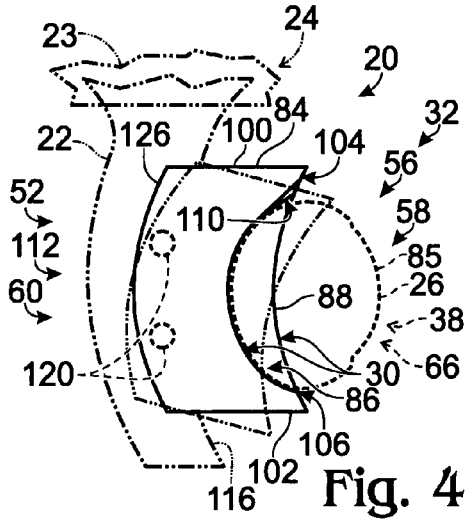
Fig. 4
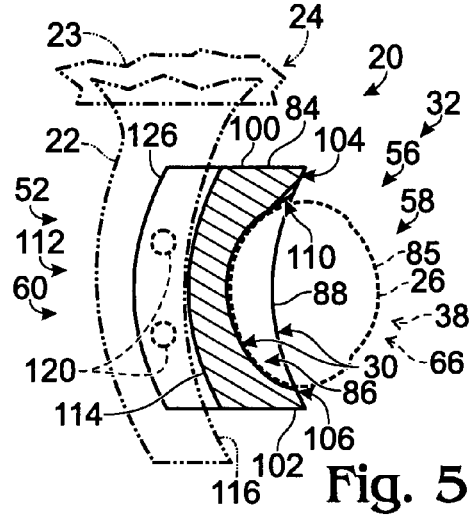
Fig. 5

FINGER ALIGNMENT DEVICES FOR TRIGGERS AND TRIGGER-ACTIVATED DEVICES INCORPORATING THE SAME

RELATED APPLICATION

This application claims priority to U.S. Provisional Patent Application Ser. No. 60/847,003, which was filed on Sep. 25, 2006 and is entitled "Ergonomic Trigger." The complete disclosure of the above-identified patent application is hereby incorporated by reference for all purposes.

BACKGROUND OF THE DISCLOSURE

Trigger-activated devices are typically activated by a user who uses a portion of the user's body, such as a finger, to move a mechanical trigger relative to the trigger-activated device. For example, a user may cause the discharge of a firearm by depressing the trigger with a finger. However, due to the complexities of the human body and the mechanisms and structures associated with movement of a finger, the desired motion of depressing the trigger may induce and/or include other undesired motions which may alter or spoil the alignment of the trigger-activated device during activation thereof. For example, when attempting to depress a trigger, the user may also unintentionally or inadvertently induce lateral and/or vertical forces into the trigger, which may alter or spoil the alignment of the trigger-activated device relative to the target or other object at which the device is aimed.

In order to achieve the most accurate possible activation of the trigger on a trigger-activated device, the user's trigger finger should properly engage and depress the trigger. Proper engagement and depression of the trigger may occur when the user is able to depress the trigger while minimizing or eliminating the introduction of lateral and/or vertical forces into the trigger, such that the user does not alter or spoil the alignment of the trigger-activated device while depressing the trigger. The ability of a user to properly engage and depress the trigger may be enhanced if the user's finger contacts the trigger in the proper location, which may vary between different users. Consistent and repeatable engagement and depression of the trigger may enhance a user's ability to achieve the most accurate possible activation of the trigger because the user will experience consistent forces and motions, both of the trigger and of the trigger finger, during each activation of the trigger.

Further discussion regarding the proper activation of triggers is available in U.S. Pat. Nos. 6,651,642 and 6,957,644; U.S. Patent Application Publication No. 2005/0188587; and United States Army Marksmanship Unit, Pistol Marksmanship Guide, ISBN 1589636317, Chapter III—Trigger Control, the complete disclosures of which are hereby incorporated by reference for all purposes.

SUMMARY OF THE DISCLOSURE

The present disclosure is directed to alignment devices for assisting proper location of fingers relative to the triggers of trigger-activated devices, trigger-activated devices, finger position indicating triggers for trigger-activated devices, and methods for activating trigger-activated devices.

The alignment devices for assisting proper location of fingers relative to triggers may include a body having a trigger face configured to engage a user's finger, a trigger-engaging region, and a position indicator disposed on the trigger face. The trigger-engaging region may be adapted to couple the alignment device to a trigger of a trigger-activated device.

The trigger-engaging region may be configured to position the trigger face in a predetermined position relative to the trigger. The position indicator may be disposed on the trigger face. The position indicator may be configured to provide an indication that at least a portion of the finger is positioned in a predetermined lateral position relative to the trigger.

The trigger-activated devices may include a body, a trigger coupled for movement relative to the body, a trigger face on the trigger, and at least one finger-positioning aid. The trigger face may extend from a first end proximate a portion of the body to a second end spaced away from the portion of the body. The trigger face may extend laterally from a first side toward a second side. The trigger face may be configured to receive a user's finger. The at least one finger-positioning aid may be disposed on the trigger face. The at least one finger-positioning aid may be configured to guide the user's finger into a predetermined position between the first side and the second side.

The finger position indicating triggers for trigger-activated devices may include a body adapted to move relative to a trigger-activated device, a trigger face on the body, and a position indicator disposed on the trigger face. The position indicator may be configured to provide an indication that a finger is positioned in a predetermined lateral position relative to the trigger.

The methods for activating a trigger-activated device may include providing a trigger-actuated device that includes at least one trigger and providing a position indicator on the at least one trigger. The position indicator may be configured to provide a user with an indication of a predetermined lateral position for an activating digit relative to the trigger. The methods for activating a trigger-activated device may further include placing the activating digit in contact with at least one of the trigger and the position indicator, positioning the activating digit in the predetermined lateral position relative to the trigger in response to the indication provided by the position indicator, and using the activating digit to activate the trigger.

BRIEF DESCRIPTION OF THE DRAWINGS

FIG. 1 is a block diagram showing an alignment device according to the present disclosure in use with a trigger-activated device.

FIG. 3 is a perspective view of an alignment device according to the present disclosure.

FIG. 4 is a side view of the alignment device of FIG. 3 shown installed on a trigger of a trigger-activated device.

FIG. 5 is a section view of the alignment device of FIG. 3, taken generally along line 5-5 in FIG. 3.

DETAILED DESCRIPTION AND BEST MODE OF THE DISCLOSURE

Figure 2:
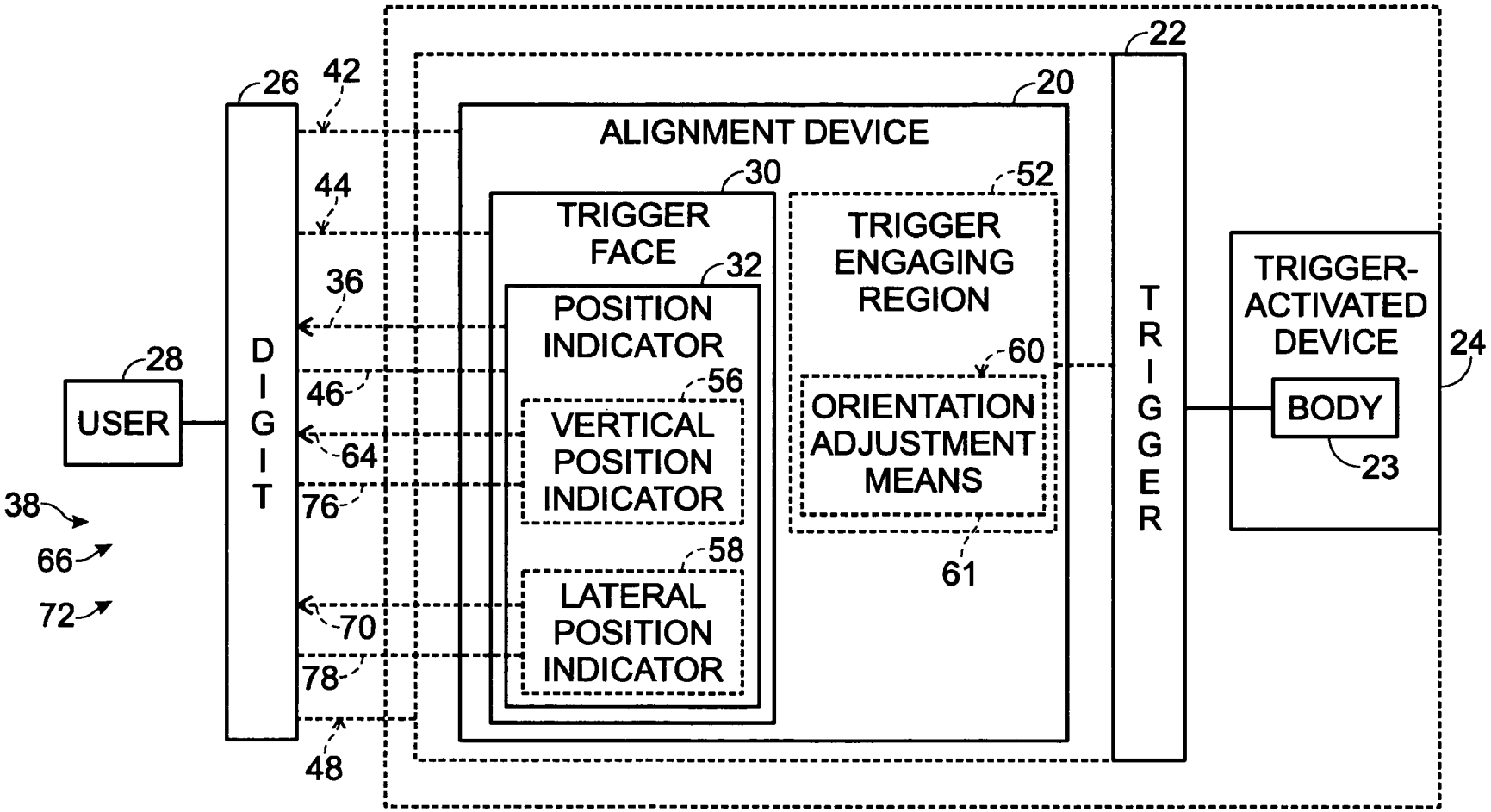
FIG. 2 is a block diagram showing another alignment device according to the present disclosure in use with a trigger-activated device.

A nonexclusive illustrative example of an alignment device according to the present disclosure for assisting proper location of a finger relative to a trigger is shown schematically in FIG. 1 and indicated generally at 20. Unless otherwise specified, alignment device 20 may, but is not required to, contain at least one of the structure, components, functionality, and/or variations described, illustrated, and/or incorporated herein. To illustrate the various features and functionalities of alignment device 20, various nonexclusive illustrative examples of alignment device 20 will be described herein with reference to a trigger 22, which may be coupled for movement relative to the body 23 of a trigger-activated device 24. Further, the various features and functionalities of alignment device 20 will be described with reference to an activating digit 26 of a user 28. As used herein, "activating digit," refers to the finger or other digit of a user that directly or indirectly (such as when contacting alignment device 20 to impart movement to trigger 22) exerts forces upon trigger 22 to cause movement of the trigger relative to the body of the trigger-activated device. Typically, although not exclusively, activating digit 26 is a user's finger. Although a trigger-activated device may be activated by a single finger, which may be the user's trigger finger, first finger, or forefinger, alignment devices 20 according to the present disclosure may be configured for use with any suitable number of fingers, such as from one to four fingers or for use with any particular finger or fingers, including use with the user's thumb.

Alignment devices 20 may be used with any trigger-activated device 24. For example, alignment devices 20 may be used with any trigger-activated device 24 where user 28 desires to achieve consistent and/or proper placement of activating digit 26 relative to the trigger 22 of the trigger-activated device 24. Nonexclusive illustrative examples of trigger-activated devices 24 with which alignment devices 20 may be used include firearms, such as pistols, rifles or shotguns, paintball guns, as well as medical or surgical devices, lasers, and the like.

As indicated in solid lines in FIGS. 1 and 2, it is within the scope of the present disclosure for alignment device 20 to optionally be discrete from trigger 22. It is additionally and/or alternatively within the scope of the present disclosure for alignment device 20 and/or trigger 22 to optionally be discrete from trigger-activated device 24. By "discrete," it is meant that the discrete component is not integrally formed with the other component even though the components thereafter may be coupled or otherwise secured together. As such, it is within the scope of the present disclosure for alignment devices 20 to optionally be embodied or implemented as add-on, and/or aftermarket, components for use with any trigger or triggers 22. Similarly, it is within the scope of the present disclosure for alignment devices 20 and/or triggers 22 to optionally be embodied or implemented as add-on, and/or aftermarket, components for use with any trigger-activated device or devices 24. For example, alignment devices 20 according to the present disclosure may be aftermarket components that are configured for use with the triggers 22 of various trigger-activated devices 24. Further, alignment devices 20 and/or triggers 22 according to the present disclosure may be aftermarket components configured for use with various trigger-activated devices 24.

As indicated in dashed lines in FIGS. 1 and 2, it is within the scope of the present disclosure for alignment device 20, including some or all of its components, to optionally be integral with trigger 22. It is also within the scope of the present disclosure for alignment device 20 and trigger 22, including some or all of their respective components, to optionally be included in, or integral to, trigger-activated device 24. As such, it is within the scope of the present disclosure for alignment device 20 to optionally be embodied or implemented as an original feature of, or direct modification to, the trigger 22 of a trigger-activated device 24. Further, it is within the scope of the present disclosure for alignment device 20 and/or trigger 22 to optionally be embodied or implemented as an original feature of, or direct modification to, a trigger-activated device 24. For example, alignment devices 20 and/or triggers 22 according to the present disclosure may be modifications to, or replacements of, the original triggers 22 of various trigger-activated devices 24.

As shown in the nonexclusive illustrative example presented in FIG. 1, alignment device 20 may include a trigger face 30 and a position indicator 32. The trigger face 30 may be configured to be engaged and/or received by a user's activating digit 26. Trigger face 30 may include any suitable surface configuration, such as a configuration that is configured to enhance the engagement between activating digit 26 and trigger face 30 and/or trigger 22. For example, at least a portion of trigger face 30 may be smooth, serrated, ridged, knurled or have some other surface treatment, such as sandblasting and the like.

Position indicator 32, which may be disposed on trigger face 30, may be configured to provide an indication 36 that at least a portion of activating digit 26 is positioned in a predetermined position 38 relative to trigger 22 and/or trigger face 30. Position indicator 32 may additionally or alternatively be referred to as a finger-positioning aid, and/or a digit-positioning aid. Indication 36 may include any feature, method, means, mechanism, and/or system configured for providing user 28 with sufficient information and/or guidance regarding positioning digit 26 in predetermined position 38 relative to trigger 22 and/or trigger face 30. For example, position indicator 32 may provide indication 36 when a portion of digit 26 overlaps at least a portion of position indicator 32. In some nonexclusive illustrative examples, position indicator 32 is configured to provide user 28 with a tactile indication that at least a portion of digit 26 is positioned in predetermined position 38 relative to trigger 22 and/or trigger face 30. Nonexclusive illustrative examples of a tactile indication may include a change in texture, a relatively abrupt change in surface profile, a localized deviation from a remaining portion of trigger face 30, and the like. In some nonexclusive illustrative examples, indication 36 may include any feature, method, means, mechanism, and/or system configured for at least partially guiding at least a portion of digit 26 towards, and/or into predetermined position 38. Nonexclusive illustrative examples of features, methods, means, mechanisms, and/or systems configured for at least partially guiding at least a portion of digit 26 towards, and/or into, predetermined position 38 include structures that are disposed on trigger 22 and/or trigger face 30 against which at least a portion of digit 26 abuts, and/or rests when digit 26 is in predetermined position 38. For example, indication 36 may include any feature, method, means, mechanism, and/or system configured for at least partially arresting, deterring, and/or stopping further motion of digit 26 beyond predetermined position 38.

Predetermined position 38 may be any position, location, and/or orientation in which a user 28 of trigger-activated device 24 desires to place digit 26 relative to trigger 22 and/or trigger face 30 when the user is aiming the device for firing or other emission responsive to sufficient movement of the trigger relative to the body of the device. As a nonexclusive illustrative example, predetermined position 38 may be a position, location, and/or orientation in which user 28 desires to consistently, and/or repeatedly position digit 26 relative to trigger 22 and/or trigger face 30. For example, predetermined position 38 may be a position, location, and/or orientation of digit 26 relative to trigger 22 and/or trigger face 30 that is selected to provide a desired activation of trigger-activated device 24 by user 28. In particular, positioning, locating, and/or orienting digit 26 in predetermined position 38 may permit more optimal and/or consistent activation of trigger-activated device 24 by user 28. For example, positioning, locating, and/or orienting digit 26 in predetermined position 38 may permit user 28 to activate trigger-activated device 24 more naturally, more comfortably, and/or without inducing any unintended and/or undesired motions and/or position changes into trigger-activated device 24 during activation thereof. Furthermore, consistently positioning, locating, and/or orienting digit 26 in predetermined position 38 may permit more consistently accurate activation of trigger-activated device 24 because the interaction between digit 26, trigger 22 and trigger-activated device 24 will be more consistent during each activation of trigger-activated device 24. It should be noted that it is within the scope of the present disclosure for such an optimal lateral position, location, and/or orientation of activating digit 26 relative to trigger 22 and/or trigger face 30 to vary with, and/or account for, variations between different users, different triggers, and/or trigger-activated devices.

As schematically indicated with the dashed lines in FIG. 1, during use of alignment device 20, activating digit 26 may variously contact or otherwise engage alignment device 20 and/or trigger 22. For example, at least a portion of activating digit 26 may at least partially contact or otherwise engage one or more of alignment device 20 (as indicated by line 42), trigger face 30 (as indicated by line 44), position indicator 32 (as indicated by line 46), and trigger 22 (as indicated by line 48).

Another nonexclusive illustrative example of an alignment device according to the present disclosure for assisting proper location of a finger relative to a trigger is shown schematically in FIG. 2 and indicated generally at 20. Unless otherwise specified, alignment device 20 may, but is not required to, contain at least one of the structure, components, functionality, and/or variations described, illustrated, and/or incorporated herein. As indicated in FIG. 2, alignment device 20 may include a trigger engaging region 52, and position indicator 32 may include at least one of a vertical position indicator 56 and a lateral position indicator 58.

Figure 12:
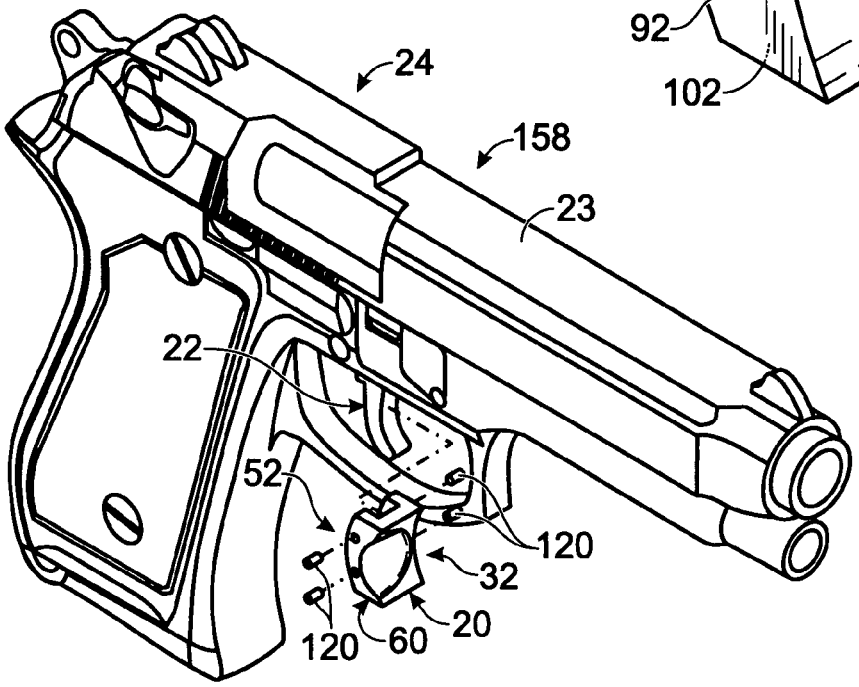
FIG. 12 is a perspective view of the alignment device of FIG. 3 and a trigger-activated device, in the form of a firearm, with which an alignment device according to the present disclosure may be used.
Figure 13:
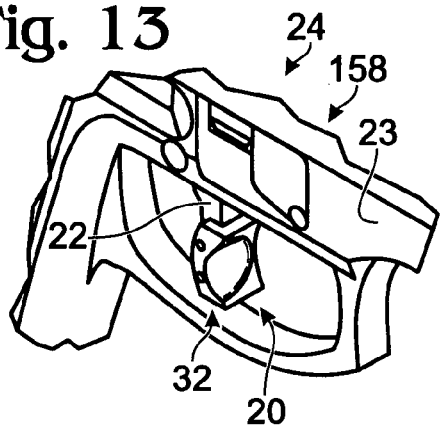
FIG. 13 is a perspective view showing the alignment device of FIG. 3 installed on a trigger-activated device.
Figure 14:
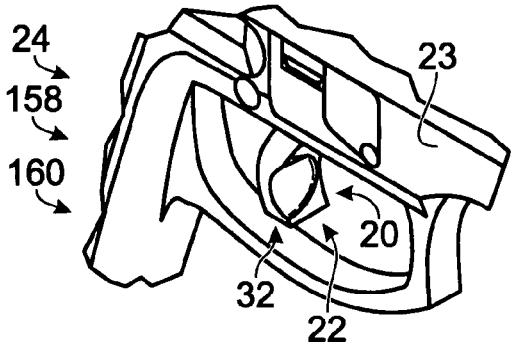
FIG. 14 is a perspective view of a trigger-activated device according to the present disclosure in which an alignment device is integral with the trigger of the trigger-activated device.

As used herein, the directions or axes corresponding to "vertical" and "lateral" are based on the common understanding of how a user activates a trigger-activated device. In particular, as used herein, the terms "vertical" and "lateral" should not be understood to require any particular orientation of a trigger-activated device 24 in space, such as relative to the earth or the user's own body. Rather, as used herein, the terms "vertical" and "lateral" are based on the anatomy of a human hand that is grasping a trigger-activated device 24, such as a handgun 158 (as depicted in FIGS. 12-14) or other firearm. As a nonexclusive illustrative example, activating digit 26 may be a user's trigger finger, which is typically the user's index finger, which is sometimes referred to as the second digit. In such an example, vertical motion of the trigger finger relative to trigger 22, and/or trigger face 30 corresponds to motion that is generally induced by abduction and adduction, or side-to-side motion, of the trigger finger. Correspondingly, lateral motion of the trigger finger relative to trigger 22, and/or trigger face 30 is the motion that is generally induced by flexion and extension of the joint between the metacarpal and the proximal phalanx of the trigger finger. Furthermore, with respect to relative positions along the "vertical" axis, "upper" should be understood to refer to portions of alignment device 20, and/or trigger 22 that are relatively proximate the body 23 of trigger-activated device 24, and "lower" should be understood to refer to portions of alignment device 20, and/or trigger 22 that are relatively spaced away from the body 23 of trigger-activated device 24.

Trigger engaging region 52 may be adapted to couple alignment device 20 to the trigger 22 of trigger-activated device 24 for movement relative to the body 23 of trigger-activated device 24. In some nonexclusive illustrative examples of alignment device 20, trigger engaging region 52 may be configured to at least partially adhesively mount alignment device 20 to the trigger 22 of trigger-activated device 24. In some nonexclusive illustrative examples of alignment device 20, trigger engaging region 52 may be configured to at least partially mount alignment device 20 to the trigger 22 of trigger-activated device 24 using at least one mechanical fastener, such as at least one screw, pin, clamp, setscrew, and the like.

In some nonexclusive illustrative examples, trigger engaging region 52 may be configured to enable positioning and/or orienting of trigger face 30 and/or position indicator 32 in a predetermined position relative to the trigger. For example, trigger engaging region 52 may be configured to permit selective vertical, lateral or other variation of alignment device 20, trigger face 30, and/or position indicator 32 relative to trigger 22 during installation, or coupling, of the alignment device to the trigger or thereafter during periods in which the alignment device is not being actively used in connection with firing or other activation of the trigger-activated device. For example, this selective adjustment of the position or orientation of the trigger face and/or position indicator relative to the trigger may be used to configure the alignment device for a particular user's shooting or other preferences, digit size, handedness (left or right), path of digit movement during activation of the trigger-activated device, and the like.

In some nonexclusive illustrative examples, trigger engaging region 52 may include an orientation adjustment mechanism, structure, or means 60. Orientation adjustment means 60 may be configured to enable adjustment and/or selection of the orientation and/or position of alignment device 20, trigger face 30, and/or position indicator 32 relative to trigger 22. For example, trigger engaging region 52 and/or alignment device 20 may be configured to permit rotation of alignment device 20, trigger face 30, and/or position indicator 32 about at least one axis relative to trigger 22.

The orientation adjustment means (or mechanism, or structure) may further include suitable retainer structure, such as retainers, set screws, clamps, and the like, for retaining the trigger face in the selected position. The retainer structure, when present, may be described as having at least a first configuration, in which the retainer structure permits selective movement or adjustment of the trigger face relative to the trigger engaging region, and a second configuration, in which the retainer structure prevents or otherwise restricts selective movement or adjustment of the trigger face relative to the trigger engaging region, at least until the retainer structure is returned to the first configuration. In some embodiments, the first configuration may be referred to as a free, or unsecured, configuration, and the second configuration may be referred to as a locked, or secured, configuration. The retainer structure is schematically illustrated in FIG. 2 at 61.

Vertical position indicator 56, which may be disposed on trigger face 30, may be configured to provide any suitable indication 64 that at least a portion of digit 26 is positioned in a predetermined vertical position 66 relative to trigger 22, and/or trigger face 30. Indication 64 may include any feature, method, means, mechanism, and/or system configured for providing user 28 with information and/or guidance regarding positioning digit 26 in a predetermined vertical position 66 relative to trigger 22 and/or trigger face 30. For example, in some nonexclusive illustrative examples, vertical position indicator 56 may include any feature, method, means, mechanism, and/or system that is configurable to provide user 28 with a tactile indication that at least a portion of digit 26 is positioned in predetermined vertical position 66. Nonexclusive illustrative examples of a tactile indication may include a change in texture, a relatively abrupt change in surface profile, a localized deviation from a remaining portion of trigger face 30, and the like. In some nonexclusive illustrative examples, indication 64 may include any feature, method, means, mechanism, and/or system configured for at least partially guiding at least a portion of digit 26 towards, and/or into, predetermined vertical position 66. Nonexclusive illustrative examples of features, methods, means, mechanisms, and/or systems configured for at least partially guiding at least a portion of digit 26 towards, and/or into, a predetermined vertical position 66 may include structures that are disposed on trigger 22 and/or trigger face 30, and against which at least a portion of digit 26 abuts and/or rests when digit 26 is in the predetermined vertical position 66. For example, indication 64 may include any feature, method, means, mechanism, and/or system configured for at least partially arresting, deterring, and/or stopping further motion of digit 26 beyond predetermined vertical position 66.

Predetermined vertical position 66 may be any position, location, and/or orientation in which a user 28 of trigger-activated device 24 desires to place digit 26 vertically relative to trigger 22 and/or trigger face 30 when the user is preparing to activate the device through movement of the trigger. As a nonexclusive illustrative example, predetermined vertical position 66 may be a vertical position, location, and/or orientation in which user 28 desires to consistently and/or repeatedly position digit 26 relative to trigger 22 and/or trigger face 30. For example, predetermined vertical position 66 may be selected to provide a desired activation of trigger-activated device 24 by user 28. In particular, positioning, locating, and/or orienting digit 26 in predetermined vertical position 66 may permit more optimal activation of trigger-activated device 24 by user 28. For example, positioning, locating, and/or orienting digit 26 in predetermined vertical position 66 may permit user 28 to activate trigger-activated device 24 more naturally, more comfortably, without inducing any unintended and/or undesired motions, and/or without inducing any undesired position changes into trigger-activated device 24 during activation thereof. Furthermore, consistently positioning, locating, and/or orienting digit 26 in predetermined vertical position 66 may permit more consistently accurate activation of trigger-activated device 24 because the interaction between digit 26, trigger 22 and trigger-activated device 24 will be more consistent during each activation of trigger-activated device 24. It should be noted that it is within the scope of the present disclosure for such an optimal vertical position, location, and/or orientation of digit 26 relative to trigger 22 and/or trigger face 30 to vary with, and/or account for, variations between different users, different triggers, and/or different trigger-activated devices.

Lateral position indicator 58, which may be disposed on trigger face 30, may be configured to provide any suitable indication 70 that at least a portion of digit 26 is positioned in a predetermined lateral position 72 relative to trigger 22, and/or trigger face 30. Indication 70 may include any feature, method, means, mechanism, and/or system configured for providing user 28 with information and/or guidance regarding positioning digit 26 in a predetermined lateral position 72 relative to trigger 22 and/or trigger face 30. For example, in some nonexclusive illustrative examples, lateral position indicator 58 may include any feature, method, means, mechanism, and/or system that is configurable to provide user 28 with a tactile indication that at least a portion of digit 26 is positioned in predetermined lateral position 72 relative to the trigger face and/or trigger. Nonexclusive illustrative examples of a tactile indication may include a change in texture, a relatively abrupt change in surface profile, a localized deviation from a remaining portion of trigger face 30, and the like. In some nonexclusive illustrative examples, indication 70 may include any feature, method, means, mechanism, and/or system that is configured for at least partially guiding at least a portion of digit 26 towards, and/or into, predetermined lateral position 72. Nonexclusive illustrative examples of features, methods, means, mechanisms, and/or systems configured for at least partially guiding at least a portion of digit 26 towards, and/or into, a predetermined lateral position 72 may include structures that are disposed on trigger 22 and/or trigger face 30, and against which at least a portion of digit 26 abuts or rests when digit 26 is in the predetermined lateral position 72. For example, indication 70 may include any feature, method, means, mechanism, and/or system configured for at least partially arresting, deterring, and/or stopping further motion of digit 26 beyond predetermined lateral position 72.

Predetermined lateral position 72 may be any position, location, and/or orientation in which a user 28 of trigger-activated device 24 desires to place digit 26 laterally relative to trigger 22, and/or trigger face 30. As a nonexclusive illustrative example, predetermined lateral position 72 may be a lateral position, location, and/or orientation in which user 28 desires to consistently, and/or repeatedly position digit 26 relative to trigger 22, and/or trigger face 30. For example, predetermined lateral position 72 may be selected to provide a desired activation of trigger-activated device 24 by user 28. In particular, positioning, locating, and/or orienting digit 26 in predetermined lateral position 72 may permit more optimal activation of trigger-activated device 24 by user 28. For example, positioning, locating, and/or orienting digit 26 in predetermined lateral position 72 may permit user 28 to activate trigger-activated device 24 more naturally, and/or more comfortably, and/or without inducing any unintended, and/or undesired motions, and/or position changes into trigger-activated device 24 during activation thereof. Furthermore, consistently positioning, locating, and/or orienting digit 26 in predetermined lateral position 72 may permit more consistently accurate activation of trigger-activated device 24 because the interaction between digit 26, trigger 22 and trigger-activated device 24 will be more consistent during each activation of trigger-activated device 24. It should be noted that it is within the scope of the present disclosure for such an optimal lateral position, location, and/or orientation of digit 26 relative to trigger 22 and/or trigger face 30 to vary with, and/or account for variations between different users, different triggers, and/or different trigger-activated devices.

As indicated by the dashed lines in FIG. 2, during use of alignment device 20, activating digit 26 may variously contact or otherwise engage alignment device 20 and/or trigger 22. For example, at least a portion of digit 26 may at least partially contact or otherwise engage one or more of alignment device 20 (as indicated by line 42), trigger face 30 (as indicated by line 44), position indicator 32 (as indicated by line 46), vertical position indicator 56 (as indicated by line 76), lateral position indicator 58 (as indicated by line 78), and trigger 22 (as indicated by line 48).

Another nonexclusive illustrative example of an alignment device 20 according to the present disclosure for assisting proper location of a finger relative to a trigger is shown in FIGS. 3-6. Unless otherwise specified, alignment device 20 may, but is not required to, contain at least one of the structure, components, functionality, and/or variations described, illustrated, and/or incorporated herein. As shown in FIGS. 3-6, alignment device 20 may include a body 84. Body 84 may include a trigger face 30 that is configured to engage a user's activating digit 26, such as finger 85, and a trigger engaging region 52.

Body 84 may include a pocket, or concave region, 86 of the trigger face 30. As shown in the nonexclusive illustrative example presented in FIGS. 3-6, at least a portion of concave region 86 has a greater curvature than a remaining portion 88 of trigger face 30. Concave region 86 is laterally oriented and extends from a first, or open, end 90 that is proximate a first side 92 of body 84 toward a second, or closed, end 94 that is proximate a point intermediate first side 92 and a second side 96 of body 84. At least a portion of concave region 86 may be configured to receive at least a portion of a user's finger 85 and to provide a position indicator 32 and/or guide finger 85 into a predetermined position relative to body 84.

At least a portion of concave region 86 may be configured to provide a vertical position indicator 56, such as by guiding at least a portion of finger 85 into a predetermined vertical position 66 relative to body 84 and trigger 22. Vertical position 66 may be a predetermined position between the first or upper end 100 of body 84 (which may be proximate the body 23 of trigger-activated device 24) and the second or lower end 102 of body 84 (which may be spaced away from the body 23 of trigger-activated device 24). For example, as shown in the nonexclusive illustrative example presented in FIG. 5, the upper and lower edges 104, 106 of concave region 86 may be configured to guide the finger 85 into predetermined vertical position 66 relative to body 84 and trigger 22. In some nonexclusive illustrative examples, the upper and lower edges 104, 106 of concave region 86 may be configured to retain finger 85 in predetermined vertical position 66, such as by at least partially limiting or restricting vertical motion of finger 85 relative to trigger face 30.

At least a portion of concave region 86 may be configured to provide a lateral position indicator 58, such as by guiding at least a portion of finger 85 into a predetermined lateral position 72 relative to body 84 and trigger 22. Lateral position 72 may be a predetermined position between the first and second sides 92, 96 of body 84. For example, the closed end 94 of concave region 86 may be configured to guide finger 85 into predetermined lateral position 72 relative to body 84 and trigger 22. As shown in the nonexclusive illustrative example presented in FIG. 6, closed end 94 engages a distal end of finger 85 and stops further lateral insertion of finger 85 beyond predetermined lateral position 72, which may prevent over-insertion of finger 85 beyond predetermined lateral position 72. As depicted in at least FIGS. 3 and 5, this closed end of concave region 86 of the trigger face may be described as being spaced further away from a corresponding trigger (such as trigger 22 shown in FIG. 5) to which the alignment device 32 is attached than a corresponding laterally adjacent portion of the trigger face, such as proximate open end 90.

In some nonexclusive illustrative examples, alignment device 20 may be configured to accommodate variation in the vertical angle with which finger 85 engages the trigger face 30. For example, the open end 90 of concave region 86 may include one or more flared regions 110. As shown in the nonexclusive illustrative example presented in FIGS. 3-5, alignment device 20 may include a flared region 110 proximate the upper edge 104 of concave region 86, which may enable downwardly-angled insertion of finger 85 into concave region 86. Conversely, a flared region proximate the lower edge 106 of concave region 86 may enable upwardly-angled insertion of finger 85 into concave region 86.

Trigger engaging region 52 may (but is not required to) include a slot, or other recess, 112 that is configured to receive and engage trigger 22. In some nonexclusive illustrative examples, slot 112 may be configured to permit selective lateral variation of the position of alignment device 20 relative to trigger 22. For example, as shown in the nonexclusive illustrative example presented in FIG. 6, slot 112 may be wider than trigger 22 such that the lateral position of body 84 relative to trigger 22 may be selectively varied within a predetermined range based on the excess lateral width of slot 112 relative to a particular trigger 22. In some embodiments, trigger engaging region 52 may be otherwise configured for being secured to the trigger of a trigger-activated device 24. Additional illustrative, non-exclusive examples include a contoured trigger engaging region that is secured to the trigger by one or more suitable fasteners or fastening mechanisms and which does not define a slot or channel into which the trigger at least partially extends. In some embodiments, the alignment device may include a bore or other passage into which the trigger is at least partially inserted. In such an embodiment, the alignment device may be described as extending completely around a portion of the trigger, while in other embodiments, the alignment device may be described as extending around, or otherwise contacting, only a portion of the trigger, such as the face and/or lateral sides of the trigger.

In some embodiments, the trigger and alignment device may be configured to have complimentary portions that are specifically shaped to be coupled together, such as with a first one of the trigger or the alignment device having one or more grooves or projections and the other one of the trigger or the alignment device having complementary projections, receivers, mounts, grooves, or the like for being secured thereto. These various illustrative, non-exclusive embodiments are considered to be within the scope of the schematic examples illustrated herein.

Trigger engaging region 52 may be configured to enable adjusting the orientation of trigger face 30 relative to trigger 22. For example, trigger engaging region 52 may be configured to permit rotation of alignment device 20 relative to trigger 22 about a lateral axis. As shown in the nonexclusive illustrative example presented in FIGS. 4-5, the forward wall 114 of slot 112 may have a greater curvature than the front surface 116 of trigger 22. Inclusion of a curved wall 114 may permit selective tilting or rotation of body 84 relative to trigger 22 as shown in FIG. 4. Additionally or alternatively, inclusion of a dovetail or otherwise laterally oversized slot may provide for additional lateral adjustment of the alignment device relative to the trigger, such as with adjustable fasteners to secure the alignment device to the trigger within a range of user-selected alignment positions.

In some nonexclusive illustrative examples, alignment device 20 may be mounted to trigger 22 using a removable mechanical fastener. For example, as shown in the nonexclusive illustrative example presented in FIGS. 3-6, body 84 may include one or more threaded holes 118 that are configured to receive a setscrew 120, which has been somewhat schematically illustrated. The setscrews 120 may extend into slot 112 to engage trigger 22 sufficiently to restrict repositioning and/or removal of the alignment device from the trigger until after the setscrews are at least partially withdrawn from engagement with the trigger. As shown in the nonexclusive illustrative example presented in FIG. 6, opposing pairs of threaded holes 118 and setscrews 120 may be used with an alignment device 20 that has a slot 112 that is wider than trigger 22, which permits lateral variation of the position of body 84 relative to trigger 22.

The distance between the trigger face 30 of alignment device 20 and the front surface 116 of trigger 22 may be selectively varied. For example, alignment device 20 may be mounted to trigger 22 such that a gap remains between the forward wall 114 of slot 112 and the front surface 116 of trigger 22. In some nonexclusive illustrative examples, the distance between concave region 86 and the forward wall 114 of slot 112 may be increased or reduced to permit a greater or lesser distance between trigger face 30 and trigger 22.

Figure 7:
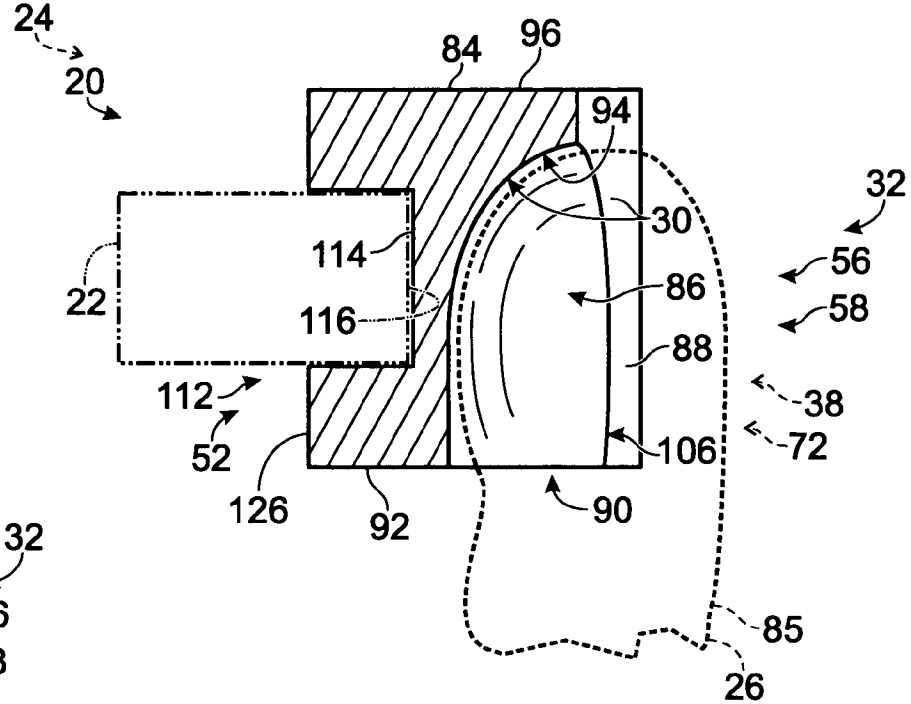
FIG. 7 is a section view of another embodiment of a trigger engaging region for the alignment device of FIG. 3, taken generally along a line corresponding to line 6-6 in FIG. 3.
Figure 6:
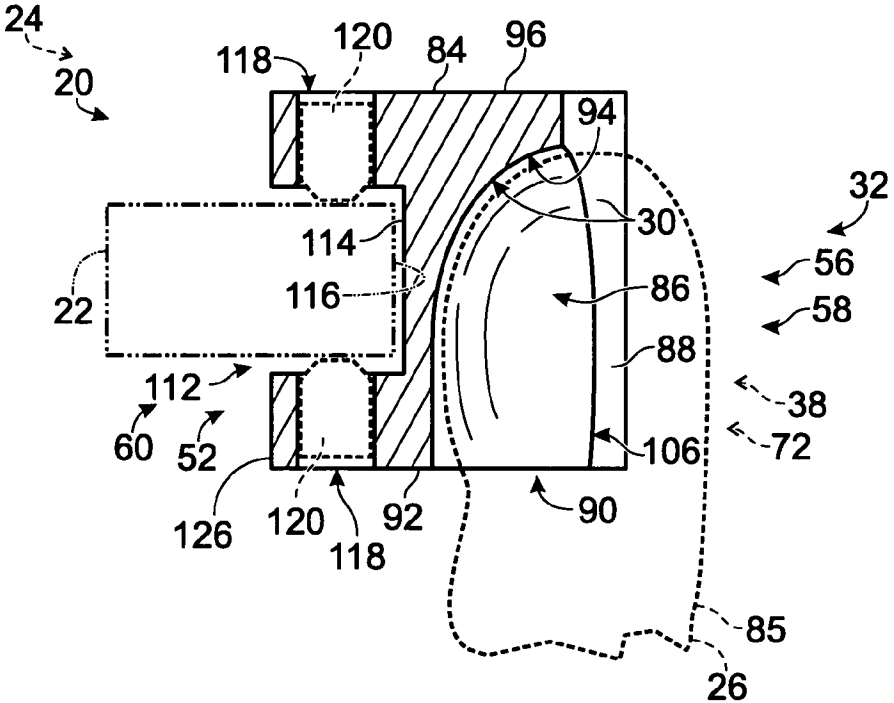
FIG. 6 is a section view of the alignment device of FIG. 3, taken generally along line 6-6 in FIG. 3.

Another nonexclusive illustrative example of an alignment device according to the present disclosure for assisting proper location of a finger relative to a trigger is shown generally at 20 in FIG. 7. Unless otherwise specified, alignment device 20 may, but is not required to, contain at least one of the structure, components, functionality, and/or variations described, illustrated and/or incorporated herein. As shown in the nonexclusive illustrative example presented in FIG. 7, alignment device 20 may be configured to be adhesively mounted to trigger 22. For example, as shown in FIG. 7, the lateral width of slot 112 may be slightly larger than the lateral width of a predetermined trigger 22, which will permit a layer of adhesive to be disposed between the walls of slot 112 and trigger 22. In some nonexclusive illustrative examples, rather than using slot 112 for adhesively mounting alignment device 20 to trigger 22, the front surface 116 of trigger 22 may be adhesively bonded to a rear surface 126 of body 84, such that slot 112 may be omitted or not used for mounting alignment device 20 to trigger 22.

In some nonexclusive illustrative examples, alignment device 20 may be configured for frictional or interference-based mounting to trigger 22. For example, similarly to the nonexclusive illustrative alignment device 20 presented in FIG. 7, the lateral width of slot 112 may be slightly smaller than the lateral width of trigger 22 such that body 84 may be permanently, or semi-permanently, press-fit onto trigger 22.

Figure 8:
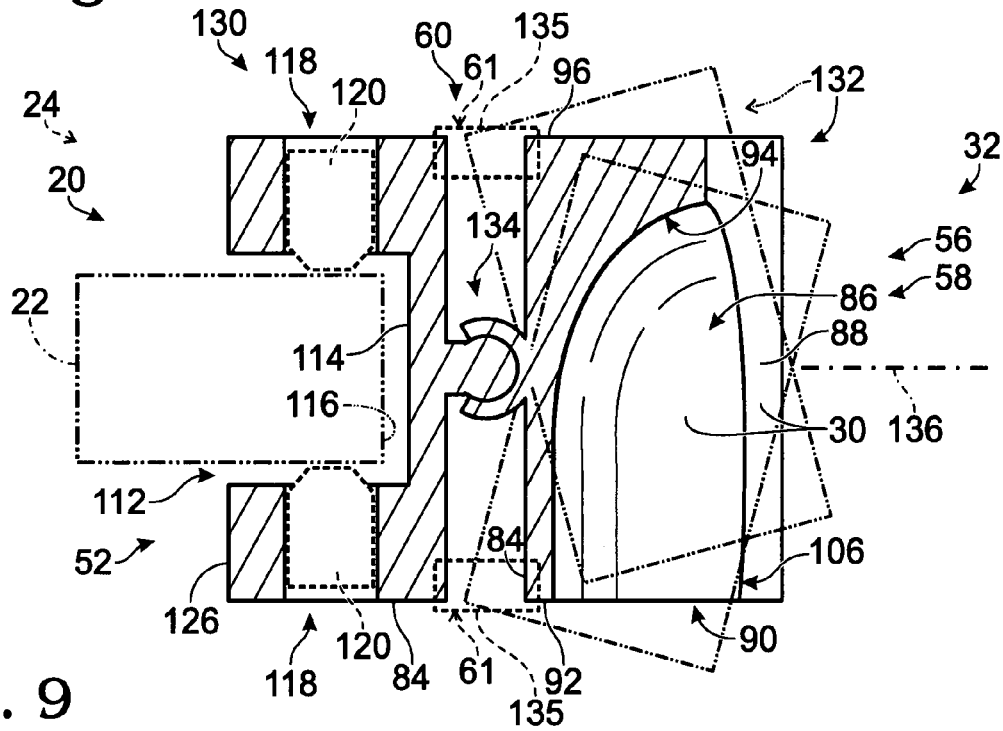
FIG. 8 is a section view another embodiment of an alignment device according to the present disclosure, taken generally along a line corresponding to line 6-6 in FIG. 3.
Figure 9:
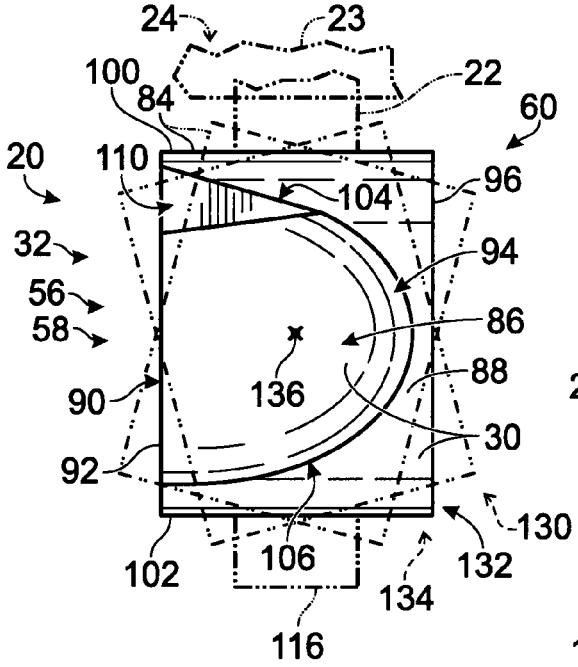
FIG. 9 is a front view of the alignment device of FIG. 8.

Another nonexclusive illustrative example of an alignment device 20 according to the present disclosure for assisting proper location of a finger relative to a trigger is shown in FIGS. 8-9. Unless otherwise specified, alignment device 20 may, but is not required to, contain at least one of the structure, components, functionality, and/or variations described, illustrated, and/or incorporated herein. As shown in the nonexclusive illustrative example presented in FIGS. 8-9, the body 84 of alignment device 20 may include a base, or trigger engagement portion, 130 and a trigger face portion 132 that are connected by a trigger face adjuster 134. Trigger face adjuster 134 may additionally or alternatively be described as an embodiment of an orientation adjustment means (or mechanism, or structure) 60. As schematically indicated in dashed lines in FIG. 8 at 61 and 135, the trigger face adjuster may include retainer structure for securing the trigger face portion in a selected position, or orientation, relative to trigger engagement portion 130. As discussed, this retainer structure may be selectively configured between at least first and second configurations, such as to permit adjustment and/or replacement of the trigger face portion 132 relative to the trigger engagement portion 130, and then to retain the portions in the selected orientation.

Trigger engagement portion 130 may be coupled to trigger 22 for movement relative to the body of the trigger-activated device 24 using any suitable method or mechanism. For example, trigger engagement portion 130 may be mounted to trigger 22 with setscrews 120, as shown in the nonexclusive illustrative example presented in FIG. 8. In some nonexclusive illustrative examples, such as where at least a portion of alignment device 20 is integral with trigger 22 and/or trigger-activated device 24, trigger engagement portion 130 may be integral with trigger 22. In further examples, the trigger engagement portion may be coupled to the trigger with an adhesive, at least one mechanical fastener other than setscrews, a press-fit engagement, and the like.

A nonexclusive illustrative example of a trigger face adjuster 134 has been somewhat schematically illustrated in FIG. 8. Trigger face adjuster 134 is adapted to enable selective adjustment and then retention of the orientation of trigger face 30 relative to trigger 22. For example, trigger face adjuster 134 may be configured to permit selective rotation of trigger face portion 132, including trigger face 30, about at least one axis relative to the trigger 22. Rotation of trigger face portion 132 relative to the trigger 22 may permit alignment of at least a portion of the trigger face 30, such as concave region 86, to better match the angle or angles with which finger 85 engages the trigger face 30. As shown in the nonexclusive illustrative example presented in FIGS. 8-9, trigger face adjuster 134 may include a ball and socket or spheroidal-type joint, which is configured for motion around an indefinite number of axes having one common center. For example, trigger face adjuster 134 may permit side-to-side or lateral rotation of trigger face portion 132, as shown in FIG. 8, and/or trigger face adjuster 134 may permit rotation of trigger face portion 132 about an axis 136 that is generally perpendicular to trigger face 30, as shown in FIG. 9. In some nonexclusive illustrative examples, trigger face adjuster 134 may include other types of joints such as hinged or pin-joints, which permit rotation about a limited number of axes. For example, some types of trigger face adjuster 134 may permit only side-to-side or lateral rotation of trigger face portion 132 or only rotation of trigger face portion 132 about axis 136.

In some nonexclusive illustrative examples, trigger face adjuster 134 may include a suitable mechanism for maintaining, or retaining, trigger face portion 132 in a particular orientation relative to the trigger 22. For example, trigger face adjuster 134 may include at least one friction lock, a set screw, or other device configurable to resist, and/or preclude movement of or within the trigger face adjuster 134. In some nonexclusive illustrative examples, such as where trigger engagement portion 130 is integral with trigger 22, trigger face adjuster 134 may be configured to permit selective detachment of trigger face portion 132 from trigger engagement portion 130.

Figure 10:
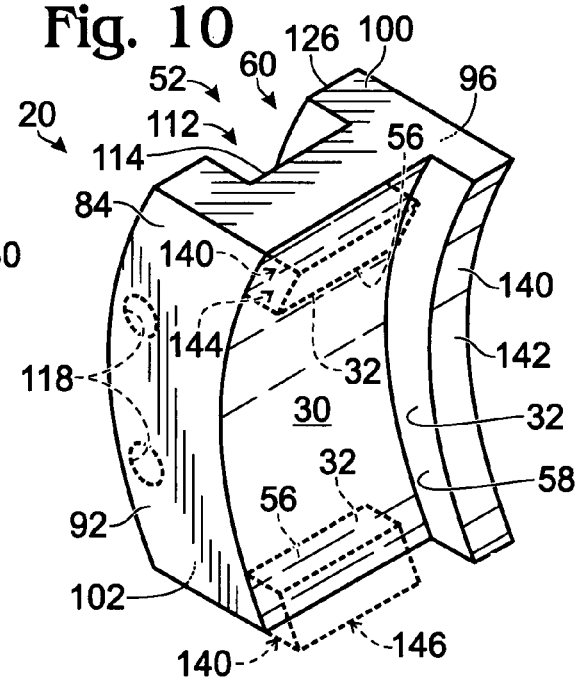
FIG. 10 is a perspective view of another embodiment of an alignment device according to the present disclosure.

Another nonexclusive illustrative example of an alignment device 20 according to the present disclosure for assisting proper location of a finger relative to a trigger is shown in FIG. 10. Unless otherwise specified, alignment device 20 may, but is not required to, contain at least one of the structure, components, functionality, and/or variations described, illustrated, and/or incorporated herein. As shown in the nonexclusive illustrative example presented in FIG. 10, alignment device 20 may include at least one projection 140 on the trigger face 30. The one or more projections 140 on the trigger face may be configured to guide a user's finger into a predetermined position relative to body 84, and/or provide a position indicator 32. For example, a projection 140 may provide an indication that the user's finger is positioned on trigger face 30 in a predetermined position when at least a portion of the user's finger overlaps, and/or abuts at least a portion of projection 140. In FIG. 10, projections 140 have been somewhat schematically illustrated, and it is within the scope of the present disclosure that the projections (when present) may have configurations other than those depicted in FIG. 10.

At least one of the projections 140 on the trigger face 30 may be configured to provide a lateral position indicator 58. For example, at least one of the projections 140 may be configured to engage a distal end of a user's finger, and/or to stop, and/or impede further lateral insertion of the finger beyond a predetermined lateral position relative to the trigger face 30. As shown in the nonexclusive illustrative example presented in FIG. 10, a projection 142, at least a portion of which may be vertically elongate, is disposed proximate the second side 96 of body 84. Projection 142 may be configured to stop and/or impede further lateral insertion of a finger beyond a predetermined lateral position when the distal end of the finger abuts projection 142. It is also within the scope of the present disclosure that the trigger face may be formed without a lateral position indicator 58 and/or with a lateral position indicator that does not impede or otherwise restrict extension of a finger across and beyond the trigger face.

At least one of the projections 140 on the trigger face 30 may be configured to provide a vertical position indicator 56. For example, at least one of the projections 140 may be configured to at least partially assist a user in positioning and/or retaining a finger in a predetermined vertical position relative to the trigger face 30. As shown in the nonexclusive illustrative example presented in FIG. 10, an upper projection 144 may be disposed on trigger face 30 proximate the upper end 100 of body 84, and/or a lower projection 146 may be disposed on trigger face 30 proximate the lower end 102 of body 84. Upper projection 144 and lower projection 146 (when present) may be configured to at least partially stop, and/or impede vertical motion of a finger beyond or away from a predetermined vertical position. In some nonexclusive illustrative examples, at least a portion of at least one of upper projection 144 and lower projection 146 may be laterally elongate. In some nonexclusive illustrative examples, alignment device 20 may include an upper projection 144 and/or a lower projection 146 without inclusion of a projection 142 configured to engage a distal end of a user's finger.

Figure 11:
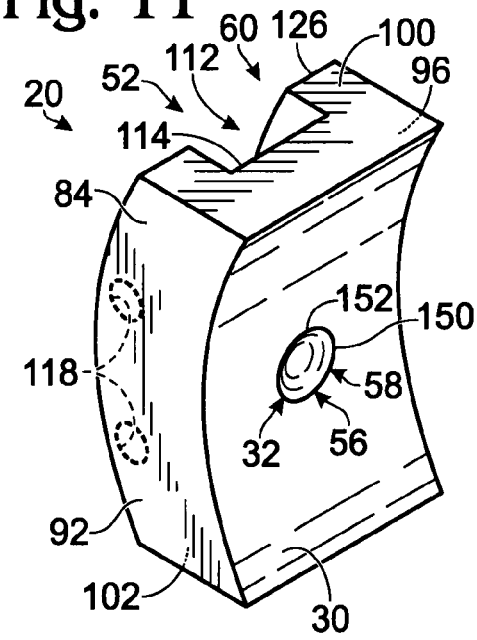
FIG. 11 is a perspective view of another embodiment of an alignment device according to the present disclosure.

Another nonexclusive illustrative example of an alignment device 20 according to the present disclosure for assisting proper location of a finger relative to a trigger is shown in FIG. 11. Unless otherwise specified, alignment device 20 may, but is not required to, contain at least one of the structure, components, functionality, and/or variations described, illustrated, and/or incorporated herein. Alignment device 20 may include at least one localized deviation 150 disposed on trigger face 30. Localized deviation 150 may be configured to provide an indication that a user's finger is positioned in a predetermined position on trigger face 30 when at least a portion of the user's finger overlaps or otherwise engages at least a portion of the localized deviation 150. In some nonexclusive illustrative examples, localized deviation 150 may be configured to provide an indication that a user's finger is positioned in a predetermined vertical position, and/or in a predetermined lateral position relative to trigger face 30, when at least a portion of the user's finger overlaps at least a portion of the localized deviation 150. As shown in the nonexclusive illustrative example presented in FIG. 11, localized deviation 150 may be a hollow 152, such as a dimple, hole, depression, recess, groove, and the like. In some nonexclusive illustrative examples, localized deviation 150 may be a projection, such as a bump, ridge, rib, button, and the like. The illustrative example shown in FIG. 11 also provides a graphical example of an alignment device that does not include a lateral position indicator that impedes a finger from extending across and beyond the trigger face.

Nonexclusive illustrative examples of trigger-activated devices 24 incorporating, or suitable for use with, alignment devices 20 according to the present disclosure for assisting proper location of a finger relative to a trigger are shown in FIGS. 12-14. Unless otherwise specified, alignment devices 20 and trigger-activated devices 24 may, but are not required to, contain at least one of the structure, components, functionality, and/or variations described, illustrated, and/or incorporated herein.

As shown in the nonexclusive illustrative example presented in FIGS. 12-13, an alignment device 20 in the form of a discrete component, such as an add-on and/or aftermarket component, may be used with trigger-activated devices 24, such as a handgun 158. As noted above, in addition to use with a handgun, alignment devices 20 may additionally or alternatively be used with other firearms, paintball guns, medical or surgical devices, lasers, and the like. Alignment devices 20 may be configured for attachment to a handgun 158, which may otherwise be unmodified, using any suitable fastening, or coupling, mechanism, such as those described herein. In FIGS. 12-13, a plurality of setscrews 120 are shown as nonexclusive illustrative examples of a suitable fastening mechanism.

As shown in the nonexclusive illustrative example presented in FIG. 14, trigger-activated devices 24, such as a handgun 160, may incorporate an integral alignment device 20 into trigger 22. A trigger 22 that incorporates an integral alignment device 20, as shown in FIG. 14, may be in the form of a modification to, or replacement for, the existing trigger of a handgun 158, or it may be in the form of a trigger that was originally supplied with handgun 160.

Some nonexclusive illustrative examples of the alignment devices 20 presented herein may be configured for optional right-handed or left-handed use, which may enable use by either right-handed or left-handed individuals. In some nonexclusive illustrative examples, alignment device 20 may be suitable for optional right-handed or left-handed use without modification, reconfiguration, repositioning, reorienting or reinstallation. For example, as shown in the nonexclusive illustrative example presented in FIG. 11, a position indicator 32 in the form of a localized deviation 150 on trigger face 30 may be suitable for right-handed or left-handed use without any need to reposition or alter the installation, and/or orientation of alignment device 20 relative to trigger 22. In some nonexclusive illustrative examples, alignment device 20 may be suitable for optional right-handed or left-handed use after inverting and reinstalling the device. For example, as may be observed on the nonexclusive illustrative example presented in FIGS. 3-7, the open end 90 of concave region 86 may be changed from the right-hand side of trigger-activated device 24 to the left-hand side by inverting body 84. In some nonexclusive illustrative examples, alignment device 20 may be suitable for optional right-handed or left-handed use based on rotation of a portion of the alignment device 20 relative to trigger 22 without removing alignment device 20 from trigger 22. For example, as shown in the nonexclusive illustrative example presented in FIGS. 8-9, trigger face portion 132 may be rotated about axis 136 such that the open end 90 of concave region 86 is presented to either the right-hand side or the left-hand side of trigger-activated device 24.

Some nonexclusive illustrative examples of alignment devices 20 presented herein may be configured and/or optimized for dedicated right-handed or left-handed use. In some nonexclusive illustrative examples, at least a portion of alignment device 20, such as at least a portion of position indicator 32, may, include one or more asymmetries that are configured to optimize alignment device 20 for dedicated right-handed or left-handed use. For example, concave region 86 may include a flared region 110 that may be configured to more readily receive a downwardly angled right forefinger, as shown in FIGS. 3-5, 9 and 12-14. In some nonexclusive illustrative examples, at least a portion of alignment device 20, such as trigger face 30, may be spatially fixed relative to the trigger 22. For example, alignment device 20 may be a single piece that is adhesively mounted to trigger 22, as shown in FIG. 7, or alignment device 20 may be integral with trigger 22, as shown in FIG. 14.

Alignment devices 20 according to the present disclosure may be formed in any suitable number of components, from a single monolithic structure, to a structure that includes two or more interconnected components. When the devices are formed from two or more components, the components may be permanently or releasably secured together, either during or after formation of the components. If a portion or all of the alignment devices is formed via a molding process, any suitable molding technique, including injection molding and over-molding techniques, may be (but are not required to be) utilized. In some embodiments, the alignment devices may include a trigger-engaging region 52 that is configured to be releasably coupled to one or more trigger faces, or corresponding portions of body 23 that include a trigger face and position indicator. In such an embodiment, the trigger-engaging region may be used with a plurality of trigger faces (and/or corresponding body portions that contain a trigger face and position indicator) to provide an alignment device kit having a plurality of interchangeable trigger faces, and/or components containing trigger faces), which can be interchangeably coupled to the trigger-engaging region, or portion.

Alignment devices 20 according to the present disclosure may be formed from any suitable material, or combination of materials. Illustrative, non-exclusive examples of suitable materials that may be used, alone or in combination, include metal, plastics, wood, glass, resins, curable polymers, and the like. In some embodiments, the alignment devices may be formed from a combination of materials having different properties. As an illustrative example, the devices may (but are not required to) include a metallic or other rigid body 23 and/or trigger-engaging region 52. Additionally or alternatively, the devices may (but are not required to) include a resilient, tactile, and/or grip-enhancing trigger face 30 and/or position indicator 32.

A nonexclusive illustrative example of a method for activating a trigger-activated device may include providing a trigger-actuated device that includes at least one trigger. The trigger-activated device may be a firearm or a medical device or any other trigger-activated device where a user desires to achieve consistent, and/or proper placement of an activating digit relative to the trigger of the trigger-activated device. The nonexclusive illustrative example of a method for activating a trigger-activated device may further include providing a position indicator on the at least one trigger. The position indicator may be configured to provide a user with an indication of a predetermined lateral position for an activating digit, which may be a finger, relative to the trigger. In some nonexclusive illustrative examples, the position indicator may be configured to provide a user with an indication of a predetermined vertical position for an activating digit relative to the trigger. The nonexclusive illustrative example of a method for activating a trigger-activated device may further include placing the activating digit in contact with at least one of the trigger and the position indicator, positioning the activating digit in the predetermined lateral position relative to the trigger in response to the indication provided by the position indicator, and using the activating digit to activate the trigger.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. An alignment device for assisting proper location of a finger relative to a trigger, the alignment device comprising:

a body having a trigger face configured to engage a user's finger;

a trigger-engaging region adapted to couple the alignment device to a trigger of a trigger-activated device, wherein the trigger-engaging region is configured to position the trigger face in a predetermined position relative to the trigger; and a position indicator disposed on the trigger face, wherein the position indicator is configured to provide an indication that at least a portion of the finger is positioned in a predetermined lateral position relative to the trigger, and at least a portion of the position indicator is spaced farther away from the trigger than a laterally adjacent portion of the trigger face when the alignment device is coupled to the trigger, and further wherein the position indicator comprises a concave region of the trigger face, at least a portion of the concave region has a greater curvature than a remaining portion of the trigger face, and the concave region is configured to receive at least a portion of the finger.

2. The alignment device of claim 1, wherein the position indicator is configured to provide an indication that at least a portion of the finger is positioned in a predetermined vertical position relative to the trigger.

3. The alignment device of claim 1, wherein the concave region is laterally oriented and extends from an open end proximate a first side of the body toward a closed end that is proximate a point intermediate the first side and a second side of the body.

4. The alignment device of claim 3, wherein the closed end is configured to engage and stop further lateral insertion of a distal end of the finger that is received in the concave region.

5. The alignment device of claim 1, wherein the position indicator further comprises at least one projection on the trigger face.

6. The alignment device of claim 5, wherein the at least one projection comprises at least one of an upper projection that is disposed proximate an upper end of the trigger face and a lower projection that is disposed proximate a lower end of the trigger face.

7. The alignment device of claim 5, wherein the at least one projection comprises at least one projection that is disposed proximate a side of the body.

8. The alignment device of claim 7, wherein the at least one projection that is disposed proximate a side of the body is configured to engage a distal end of the finger.

9. The alignment device of claim 8, wherein the at least one projection is configured to stop further lateral insertion of the finger beyond the predetermined lateral position relative to the trigger.

10. The alignment device of claim 1, wherein the position indicator further comprises at least one hollow on the trigger face.

11. The alignment device of claim 1, wherein the alignment device includes means for adjusting the orientation of the trigger face relative to the trigger.

12. The alignment device of claim 11, wherein the means for adjusting the orientation of the trigger face relative to the trigger is configured to permit selective rotation of the trigger face about at least one axis relative to the trigger.

13. The alignment device of claim 1, wherein the alignment device is configured to enable optional configuration of the alignment device for right-handed use or for left-handed use.

14. A trigger-activated device, comprising:

a trigger; and an alignment device as recited in claim 1, wherein the alignment device is mounted to the trigger.

15. The trigger-activated device of claim 14, wherein the trigger-activated device is a firearm, a medical device, or a surgical device.

16. The alignment device of claim 1, wherein the predetermined position includes a position in which the trigger-engaging region overlaps with a front surface of the trigger.

17. The alignment device of claim 1, wherein the alignment device does not extend rearward of the trigger when the alignment device is coupled to the trigger by the trigger-engaging region.

18. The alignment device of claim 1, wherein the alignment device is free of a safety system that restricts activation of the trigger when the alignment device is coupled to the trigger by the trigger-engaging region.

19. The trigger-activated device of claim 1, wherein the predetermined position includes a position in which the at least one finger-positioning aid overlaps with a portion of the trigger face on the front surface of the trigger.

20. A trigger-activated device, comprising:

a body;

a trigger coupled for movement relative to the body, wherein the trigger includes a front side and a rear side generally opposite the front side;

a trigger face on the front side of the trigger, wherein the trigger face extends from a first end proximate a portion of the body to a second end spaced away from the portion of the body, extends laterally from a first side toward a second side, and is configured to receive a user's finger; and at least one finger-positioning aid disposed on the trigger face, wherein the at least one finger-positioning aid is configured to guide the user's finger into a predetermined position between the first side and the second side, and wherein at least a portion of the at least one finger-positioning aid is spaced farther away from the rear side of the trigger than a laterally adjacent portion of the trigger face, and further wherein the at least one finger-positioning aid comprises a laterally oriented concave region of the trigger face, wherein the concave region extends from an open end proximate the first side toward a closed end proximate a point intermediate the first side and the second side.

21. The trigger-activated device of claim 20, wherein the predetermined position between the first side and the second side is a first predetermined position and the at least one finger-positioning aid is configured to guide the user's finger into a second predetermined position between the first end and the second end.

22. The trigger-activated device of claim 21, wherein the second end of the at least one finger-positioning aid is configured to guide the user's finger into the second predetermined position between the first end and the second end; and further wherein the open end of the concave region is configured to guide the user's finger into the first predetermined position between the first side and the second side.

23. The trigger-activated device of claim 20, wherein the at least one finger-positioning aid provides a tactile indication that the user's finger is positioned on the trigger face in the predetermined position.

24. The trigger-activated device of claim 23, wherein the at least one finger-positioning aid further comprises at least one projection on the trigger face.

25. The trigger-activated device of claim 24, wherein the at least one projection on the trigger face is configured to indicate that the user's finger is positioned on the trigger face in the predetermined position when at least a portion of the user's finger overlaps at least a portion of the at least one projection.

26. The trigger-activated device of claim 24, wherein the at least one projection on the trigger face is configured to indicate that the user's finger is positioned on the trigger face in the predetermined position when at least a portion of the user's finger abuts at least a portion of the at least one projection.

27. The trigger-activated device of claim 20, wherein at least a portion of the trigger face is configured for selective rotation about at least one axis relative to at least a portion of the trigger.

28. The trigger-activated device of claim 20, wherein the trigger comprises:

a trigger base portion coupled for movement relative to the body; and a trigger face portion, wherein the trigger face portion comprises the trigger face and the at least one finger-positioning aid, wherein the trigger face portion is removably attached to the trigger base portion.

29. The trigger-activated device of claim 20, wherein the at least one finger-positioning aid does not extend rearward of the trigger.

30. The trigger-activated device of claim 20, wherein the trigger-activated device is a firearm, a medical device, or a surgical device.

* * * * *